US006762388B2

(12) United States Patent
Schellekens et al.

(10) Patent No.: US 6,762,388 B2
(45) Date of Patent: Jul. 13, 2004

(54) VACUUM CARTRIDGE FOR AN ELECTRICAL PROTECTION APPARATUS SUCH AS A SWITCH OR CIRCUIT BREAKER

(75) Inventors: Hans Schellekens, La Terrasse (FR); Serge Olive, Saint Paul de Varces (FR)

(73) Assignee: Schneider Electric Industries SAS (FR)

( * ) Notice: Subject to any disclaimer, the term of this patent is extended or adjusted under 35 U.S.C. 154(b) by 0 days.

(21) Appl. No.: 10/457,554

(22) Filed: Jun. 10, 2003

(65) Prior Publication Data

US 2004/0000536 A1 Jan. 1, 2004

(30) Foreign Application Priority Data

Jun. 27, 2002 (FR) ..... 02 08033

(51) Int. Cl.[7] ..... H01H 33/66

(52) U.S. Cl. ..... 218/123; 218/129; 218/134; 218/136

(58) Field of Search ..... 218/118, 123–129, 218/134, 136, 137, 139, 141–143, 146, 147, 10, 42

(56) References Cited

U.S. PATENT DOCUMENTS

| | | | | |
|---|---|---|---|---|
| 3,372,258 A | * | 3/1968 | Porter | 218/126 |
| 3,851,203 A | | 11/1974 | Harris | 313/233 |
| 4,982,059 A | | 1/1991 | Bestel | 200/144 |
| 5,763,848 A | * | 6/1998 | Hakamata et al. | 218/128 |

FOREIGN PATENT DOCUMENTS

| | | |
|---|---|---|
| DE | 195 19 078 A1 | 11/1996 |
| DE | 196 03 158 A1 | 7/1997 |
| EP | 1 037 233 A2 | 9/2000 |
| EP | 1 152 445 A1 | 11/2001 |
| FR | 2 410 350 | 6/1979 |
| FR | 2 745 118 A1 | 8/1997 |
| JP | 63-160122 | 7/1988 |
| JP | 04101315 | 4/1992 |

* cited by examiner

*Primary Examiner*—Elvin Enad
*Assistant Examiner*—M. Fishman
(74) *Attorney, Agent, or Firm*—Parkhurst & Wendel, L.L.P.

(57) ABSTRACT

The present invention relates to a vacuum cartridge for an electrical protection apparatus such as a switch or a circuit breaker, said cartridge comprising an enclosure of substantially cylindrical shape closed by two end plates, two contacts extending axially inside the enclosure, at least one whereof, called the movable contact, is connected to an operating mechanism and is mounted sliding between a closed position of the contacts enabling the current to flow and a position wherein the contacts are separated and form an electric arc between them, and a means for producing an axial magnetic field in the arc formation zone. This cartridge comprises at least one conducting shield fitted around the periphery of at least one of the contacts, said shield being shaped and arranged in such a way as to withstand the electric field arising from the recovery voltage imposed by the power system after breaking and to thus considerably reduce the electric field at the edge of said contact.

17 Claims, 9 Drawing Sheets

VACUUM CARTRIDGE FOR AN ELECTRICAL PROTECTION APPARATUS SUCH AS A SWITCH OR CIRCUIT BREAKER

BACKGROUND OF THE INVENTION

The present invention relates to a vacuum cartridge for an electrical protection apparatus such as a switch or a circuit breaker, said cartridge comprising an enclosure of substantially cylindrical shape closed by two end plates, two contacts extending axially inside the enclosure, at least one whereof, called the movable contact, is connected to an operating mechanism and is mounted sliding between a closed position of the contacts enabling the current to flow and a position wherein the contacts are separated and form an electric arc between them, and a means for producing an axial magnetic field in the arc formation zone. A vacuum circuit breaker of the above-mentioned kind is described in the document FR 2,682,808 or FR 2,726,396 filed by the applicant.

In this type of circuit breaker, the vacuum cartridges have under strong currents a breaking capacity which is limited by the following phenomenon. When the current flows, the arc moves liquid matter coming from the melting contact to the edge of the contacts. This very hot liquid matter (about 2000°) is situated at the edge of the contacts at the moment breaking occurs. After breaking, the recovery voltage imposed by the power system is established between the two contacts. On account of the geometric shape of the contacts, the electric field generated by this voltage is maximum at the edges of the contacts. This gives rise to the following undesirable phenomena. Firstly, when cooling, the liquid continuously gives off metallic vapors and gases. These emissions create an atmosphere with a high gas density which, in an environment normally in a strong vacuum, has a reduced dielectric strength. Secondly, the electric field, present just above the liquefied and very hot matter, gives rise to emission of electrons by a thermoelectric mechanism. These free electrons ionize the vapor and the gas. The combination of these two phenomena then leads to rearcings and to failure of the cartridge in breaking. In addition, the electric field is liable to deform the surface of the liquid increasing the electric field even further. This is a detrimental phenomenon that is self-amplifying and that can lead to rearcing.

To overcome these drawbacks in industrialized cartridges, certain measures have been taken that consist in respecting a distance, called the optimal distance, between the contacts and the wall of the enclosure, which distance guarantees a maximum breaking capacity. This therefore imposes constraints as to the volume of the cartridge.

Furthermore, some of the cartridges of the kind referred to above, as described in the document FR 2,726,396, in addition comprise a metal shield acting as the wall of the enclosure. This shield is connected to one of the contacts, more often than not to the stationary contact, and secondarily produces an increase of the electric field created at the level of the movable contact. Thus, dielectrically, the cartridge is considered as being asymmetric. The electric field is stronger at the edges of the movable contact than at the edges of the stationary contact. And, depending on the polarity of the recovery voltage, the dielectric strength after breaking is more or less good. Thus it is preferable for it to be the stationary contact that is subjected to a negative voltage rather than the movable contact. When the movable contact is subjected to a negative voltage with respect to the stationary contact, the hot matter emits more electrons due to the presence of the stronger electric field, which increases the risks of rearcing. This asymmetry in terms of geometry is also expressed by an asymmetry in terms of breaking capacity, the difference being about 15% for a rated current of 25 kA rms.

SUMMARY OF THE INVENTION

The present invention overcomes these problems and proposes a vacuum cartridge with improved breaking capacity and whose behavior on breaking is more symmetric. The cartridge achieved according to the invention can also be reduced in size.

For this purpose, the object of the present invention is to achieve a vacuum cartridge of the previously mentioned kind, this cartridge being characterized in that it comprises at least one conducting shield fitted around the periphery of at least one of the contacts, said shield being shaped and arranged in such a way as to withstand the electric field arising from the recovery voltage imposed by the power system after breaking and to thus considerably reduce the electric field at the edge of the contact.

According to a particular embodiment, the above-mentioned shield is electrically connected to said contact and is sufficiently separated from said contact for the liquid running on the contact surface of said contact not to be able to reach said shield. For this purpose, a trench separates the contact surface of the contact from the edge of said shield.

According to a particular feature, the above-mentioned shield is present around the whole of said contact.

According to anothter feature, the above-mentioned shield presents a semi-annular shape and is fixed onto the bottom part of the movable contact.

According to another feature, the cartridge comprises, for one or each contact, a shield called the first shield comprising the features mentioned above taken either alone or in combination, and a shield called the second shield, fitted between the shield called the first shield and the enclosure of the cartridge, said second shield being designed to protect the enclosure from metallization by the arc vapor and secondarily producing an increase of the value of the electric field on said contact.

According to a particular feature, the physical continuity is achieved on the contacts in the closed position at a place where the wear of the contacts is minimal.

According to a particular feature, the physical continuity is achieved by means of a ring, sectors of ring or studs arranged on the contact surface of one of the contacts and situated respectively facing a ring, sectors of ring or studs arranged on the contact surface of the other of the contacts.

According to a particular feature, these rings, sectors of ring or studs are situated above the above-mentioned trench (es) separating the shield(s) called the first shield(s) from the associated contact(s).

BRIEF DESCRIPTION OF THE DRAWINGS

But other advantages and features of the invention will become more clearly apparent from the following detailed description which refers to the accompanying drawings given for example purposes only and in which.

DETAILED DESCRIPTION OF A PREFERRED EMBODIMENT

In FIGS. 1 to 6, a vacuum cartridge A can be seen designed in particular to be incorporated in a medium voltage electric circuit breaker to perform breaking of an electric circuit in case of a fault occurring or of a deliberate opening order of the electric circuit.

Figure 1:
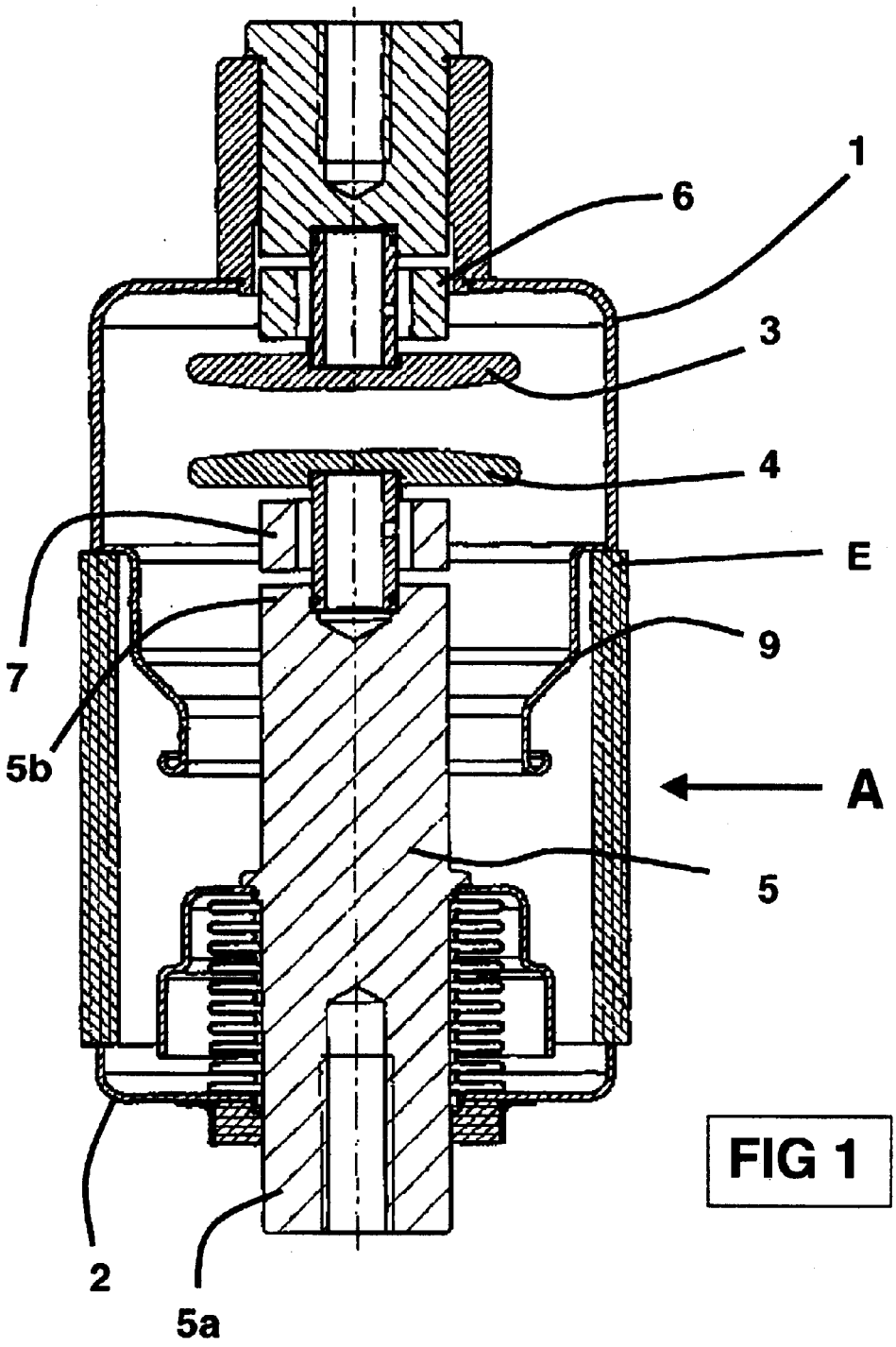
FIG. 1 is an axial sectional view of a vacuum cartridge according to the prior art.

In FIG. 1, a vacuum cartridge A according to the prior art can be seen.

This vacuum cartridge A comprises a cylindrical enclosure E closed off by two end plates 1,2 inside which there are housed two arcing contacts 3,4, respectively a stationary arcing contact 3 and a movable arcing contact 4. This movable contact 4 is mechanically connected by means of an actuating rod 5 to an operating device (not represented), said rod 5 being connected to said device via one 5*a* of its ends and being fixedly secured to the movable arcing contact 4 via its opposite end 5*b*. This operating device is able to move the above-mentioned rod 5 and the movable contact 4 in translation inside the enclosure E between two positions respectively a closed position of the contacts corresponding to normal operation of the apparatus and an open or separated position of the contacts after a fault has occurred in the electric circuit to be protected or when a deliberate opening order of the electric circuit has been made. It can also be seen that an internal winding 6,7 is fitted to the rear of each of the contacts 3,4, said windings 6,7 constituting a means of producing an axial magnetic field capable of performing diffusion of the arc created between the contacts after the contacts have separated when breaking takes place. It can also be seen that a metallic shield 9 is fitted around the end 5*b* of the actuating rod 5 connected to the movable contact 4, said shield 9 and a part of another shield 1 being situated around the movable contact 4 and producing an increase of the electric field created at the level of the movable contact during breaking.

Figure 2:
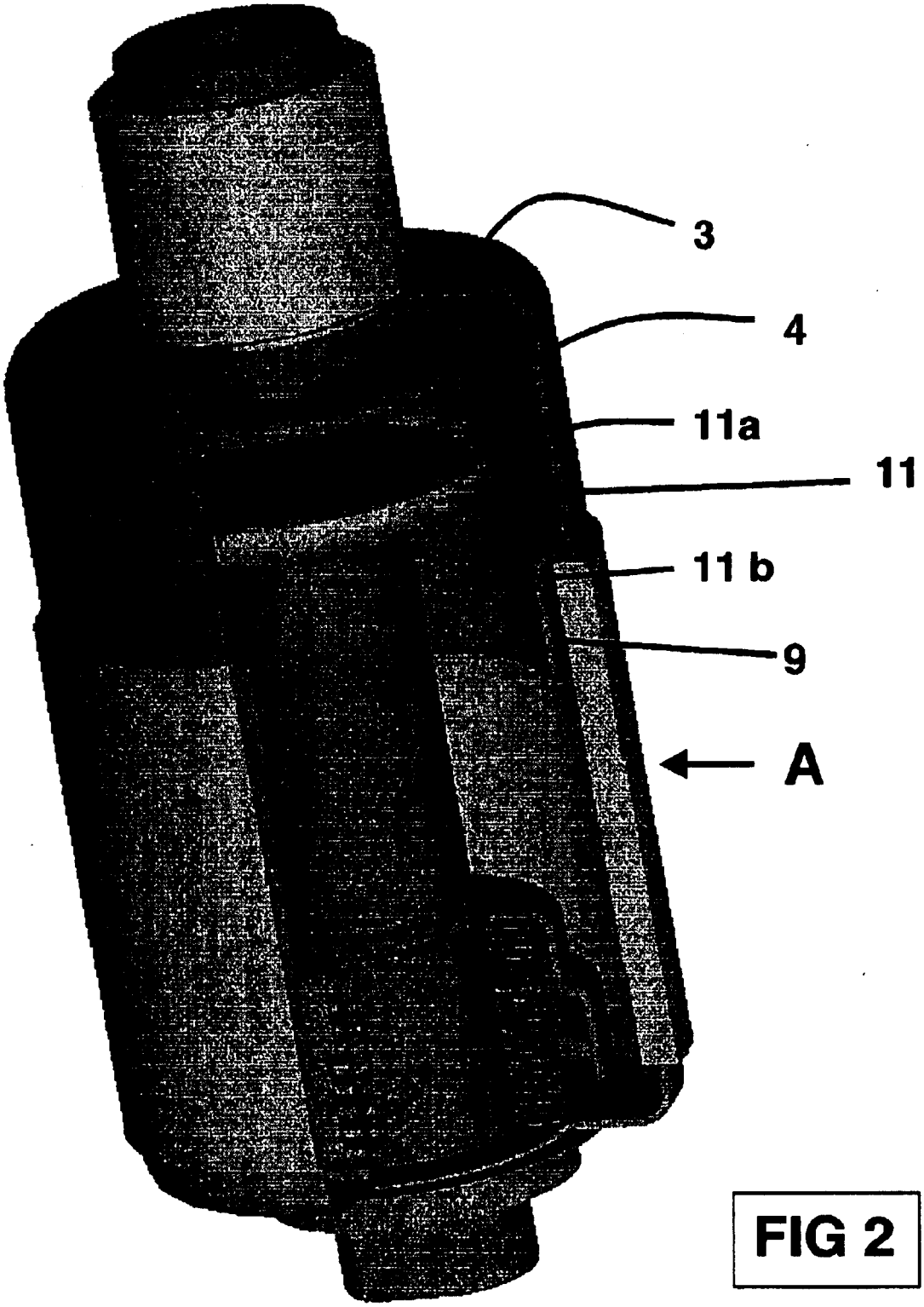
FIG. 2 is a perspective view of a vacuum cartridge according to the invention.
Figure 3:
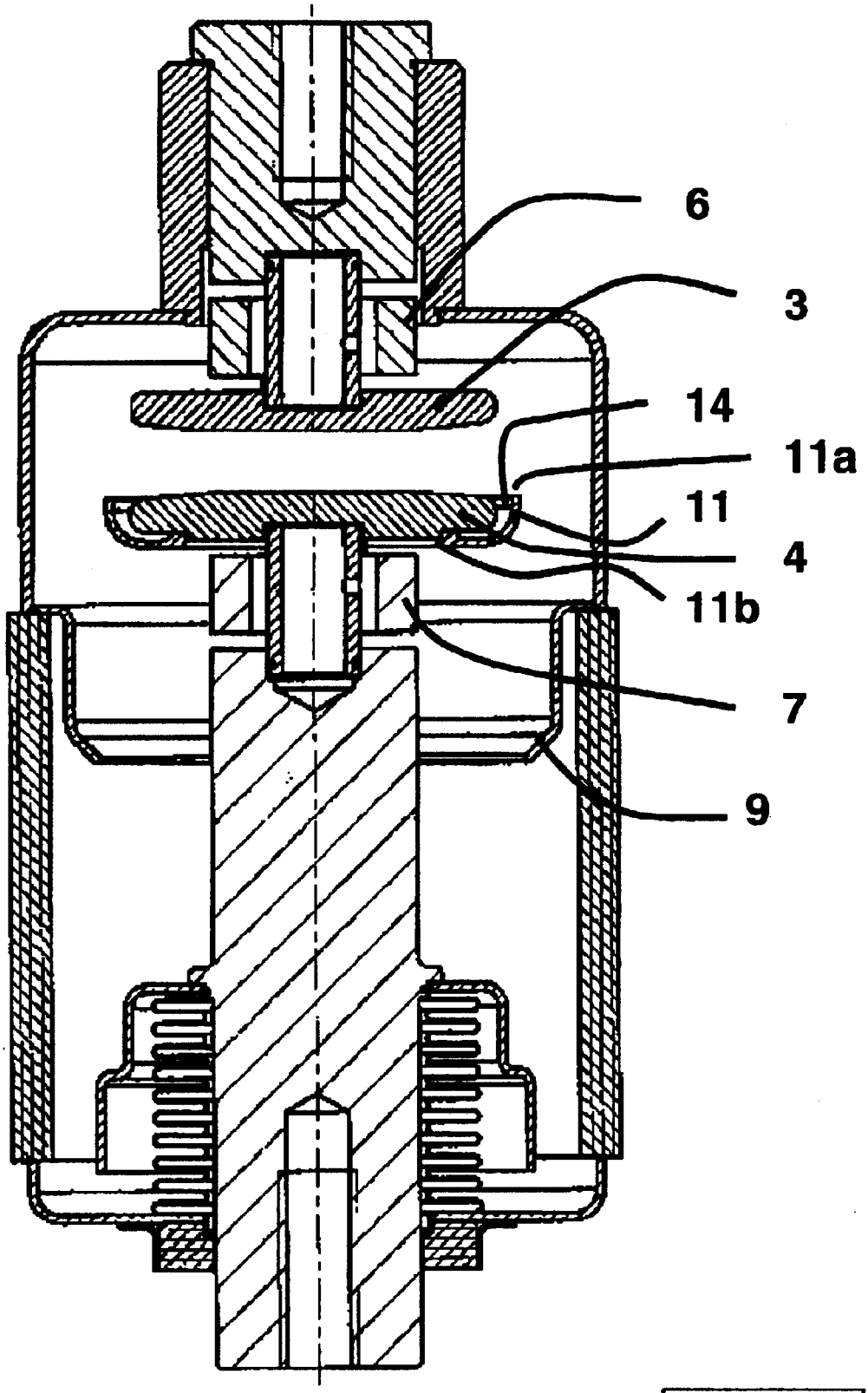
FIG. 3 is an axial sectional view of the vacuum cartridge according to the invention of the previous figure.

In FIGS. 2 and 3, a vacuum cartridge A according to the invention can be seen comprising in addition to the elements mentioned above, a shield 11 designed to reduce the electric field at the edges of the contact 4. This shield 11, of semi-annular shape, is arranged around the whole periphery of the movable contact 4 and presents two circular edges 11*a*, 11*b* of different diameters. This shield 11 is electrically connected to the movable arcing contact 4 by its bottom circular edge 11*b* and is sufficiently separated from said contact 4 for the liquid, flowing over the contact surface under the pressure of the arc, not to be able to reach said shield 11. A trench 14 is thus created between the contact 4 and the shield 11, said trench 14 having a depth of 5 mm and a width comprised between 0.5 and 4 mm. The shape of the shield 11 is such that the value of the electric field at the edges of the contact 4 is substantially reduced. Thus, the edge 11*a* of said shield 11 is flush with the contact pad or is at a slightly smaller height than that of the contact pad, the difference being comprised between 0 and 5 mm when the shield 11 is slightly set back with respect to the contact 4.

Figure 7:
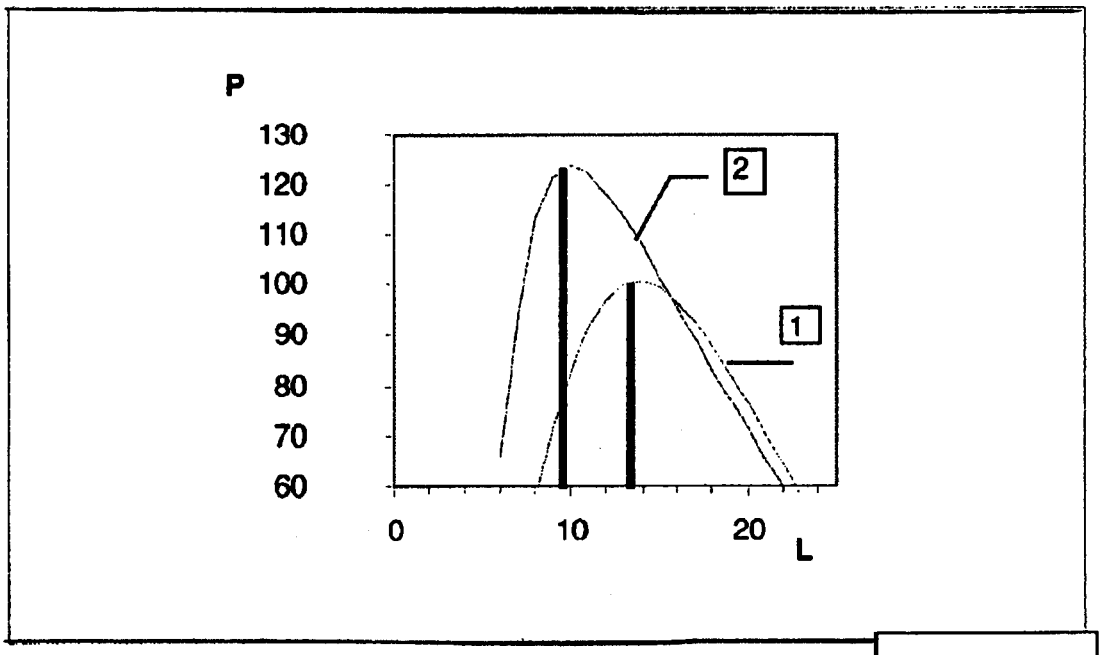
FIG. 7 is a graph illustrating the relation between the breaking capacity and the distance between the contacts and the wall, for a cartridge according to the prior art and a cartridge according to the invention.

The shield 11 has to present a good thermal resistance, as projections of drops coming from the contact 4 can make it undergo thermal shocks. Thus, the shield 11 is preferably made of copper or of the same material as the contact 4. Alternatively, this shield 11 can be made of a refractory material such as SiC, except for the insulators. The breaking capacity of the cartridge A of this figure is 20% greater than that of FIG. 1. The protective shield 11 according to the invention substantially reduces the distance between the movable contact 4 and the metal enclosure E. Thus, despite the fact that the shield 11 reduces this distance substantially, a considerable increase of the breaking capacity is obtained as indicated by the curve 2 in FIG. 7, whereas curve 1 represents the behavior of a cartridge of the prior art. This curve in fact represents the breaking capacity P in percentage on the y-axis, and the distance 1 of the shield with respect to the wall in mm on the x-axis. In this embodiment, due to the shield 11, the distance between the movable contact 4 and the wall of the enclosure E has been reduced and is now 9 mm whereas it was initially 13 mm. The shield 11 therefore presents a very high electric field which is not detrimental to the breaking capacity.

Preferably, the shield 11 is arranged around the movable contact 4, as illustrated in FIGS. 2,3, but another shield can also be placed, in addition to the first one, around the stationary contact 3.

Figure 4:
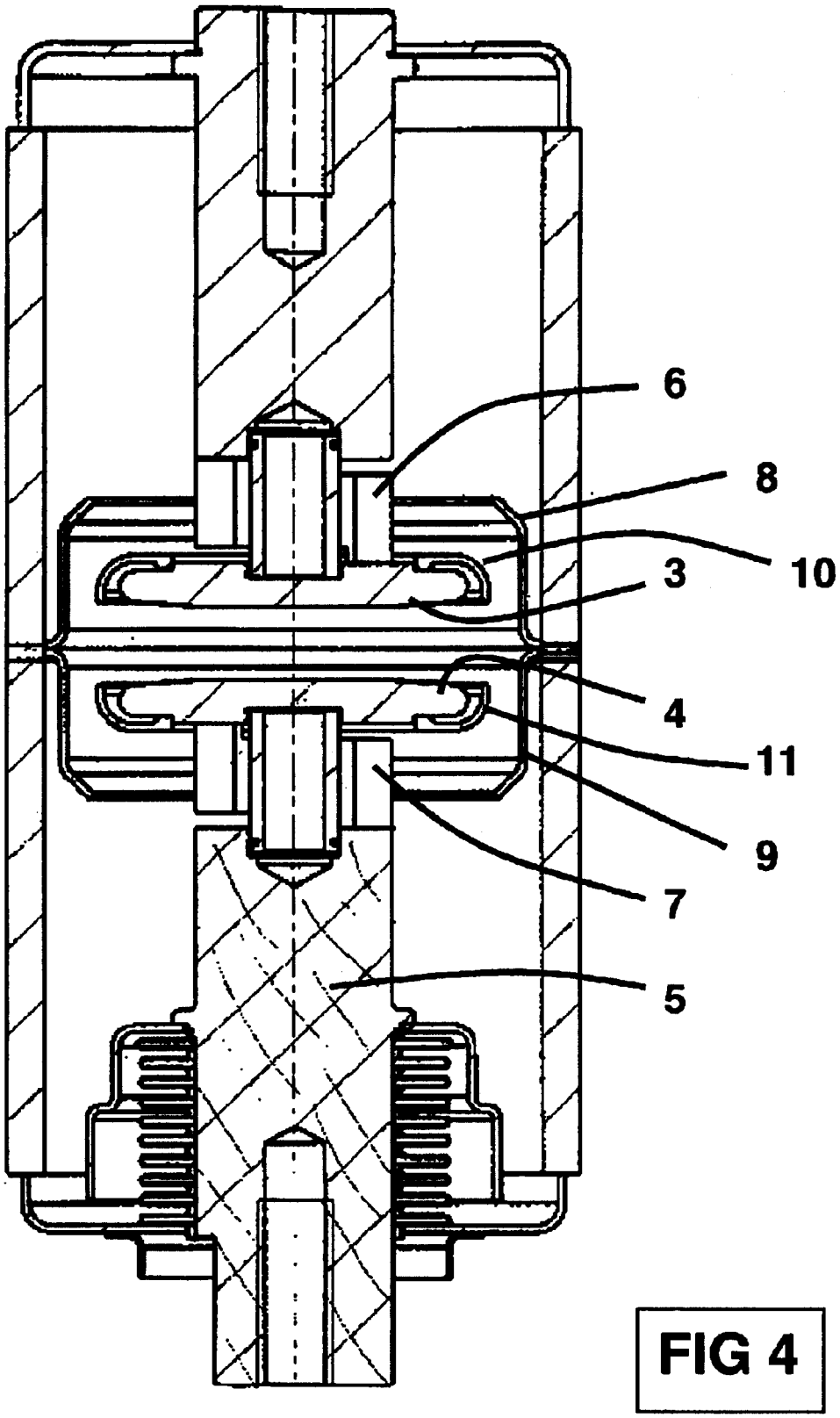
FIG. 4 is an axial sectional view of a cartridge according to the invention of symmetric type.

This shield 11 can also be advantageously used in cartridges of the symmetric type with a floating shield as illustrated in FIG. 4. This cartridge in fact presents, for each of the contacts 3,4, an internal winding 6,7 situated behind the contact 3,4, a metallic shield 8,9 here in the form of a cup extending close to the wall of the enclosure, between the internal winding 6,7 and the enclosure, and two shields 10,11 according to the invention arranged respectively around the stationary contact 3 and around the movable contact 4.

Figure 5:
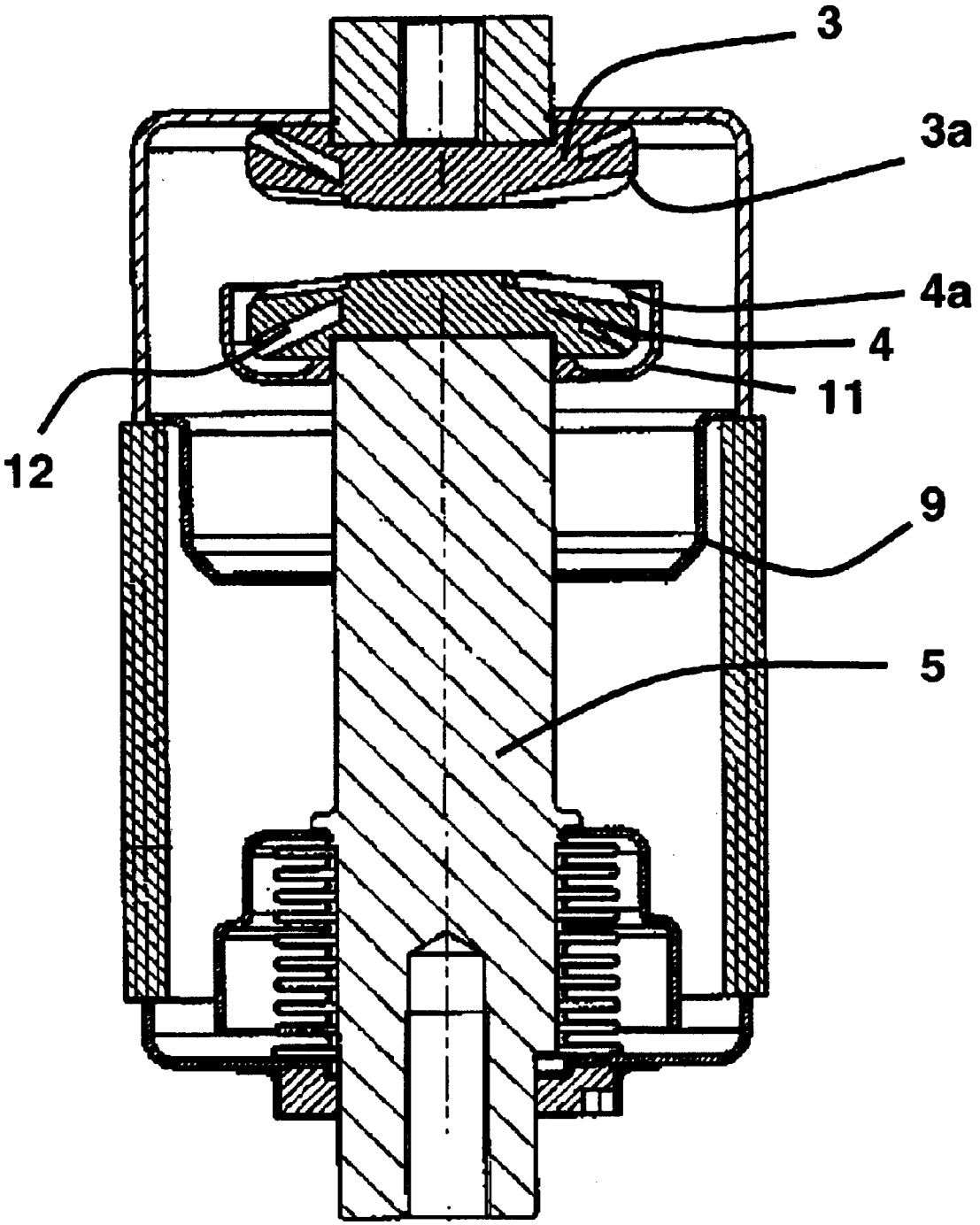
FIG. 5 is an axial sectional view of a cartridge according to the invention, the contacts being in addition equipped with inclined slits.

In FIG. 5, the invention is put into application in a cartridge A wherein the contacts are equipped with slits 12 as described in French Patent application FR 2,808,617. These slits 12 are made in the contacts 3,4 so as to receive and facilitate flow of the contact liquid in the direction of the surfaces situated under the contact surfaces, the liquid coming from melting of the contact material due to the concentration effect of the arc during breaking. These slits 12 enable the contact surface between the arcing contacts 3,4 and the liquid to be increased so as to create surfaces hidden for the arc but accessible for the liquid. This arrangement has the effect of speeding up cooling of said contact material in spite of the concentration of the arc during breaking.

Due to these arrangements, more time elapses before the liquid reaches the edges of the contacts 3*a*,4*a*. Thus, the liquid reaches the edges of the contacts 3*a*,4*a* at a time when the current values are very high.

In the embodiment described in this figure, the movable contact 4 is equipped with a shield 11 according to the invention. The advantageous effects associated with the shield 11 which surrounds the contact 4 are enhanced by the presence of the slits 12 in the contacts 3,4, since the liquid on the one hand doesn't reach the shield 11, and in addition takes longer to reach the edges of the contacts 3*a*,4*a*.

Figure 6:
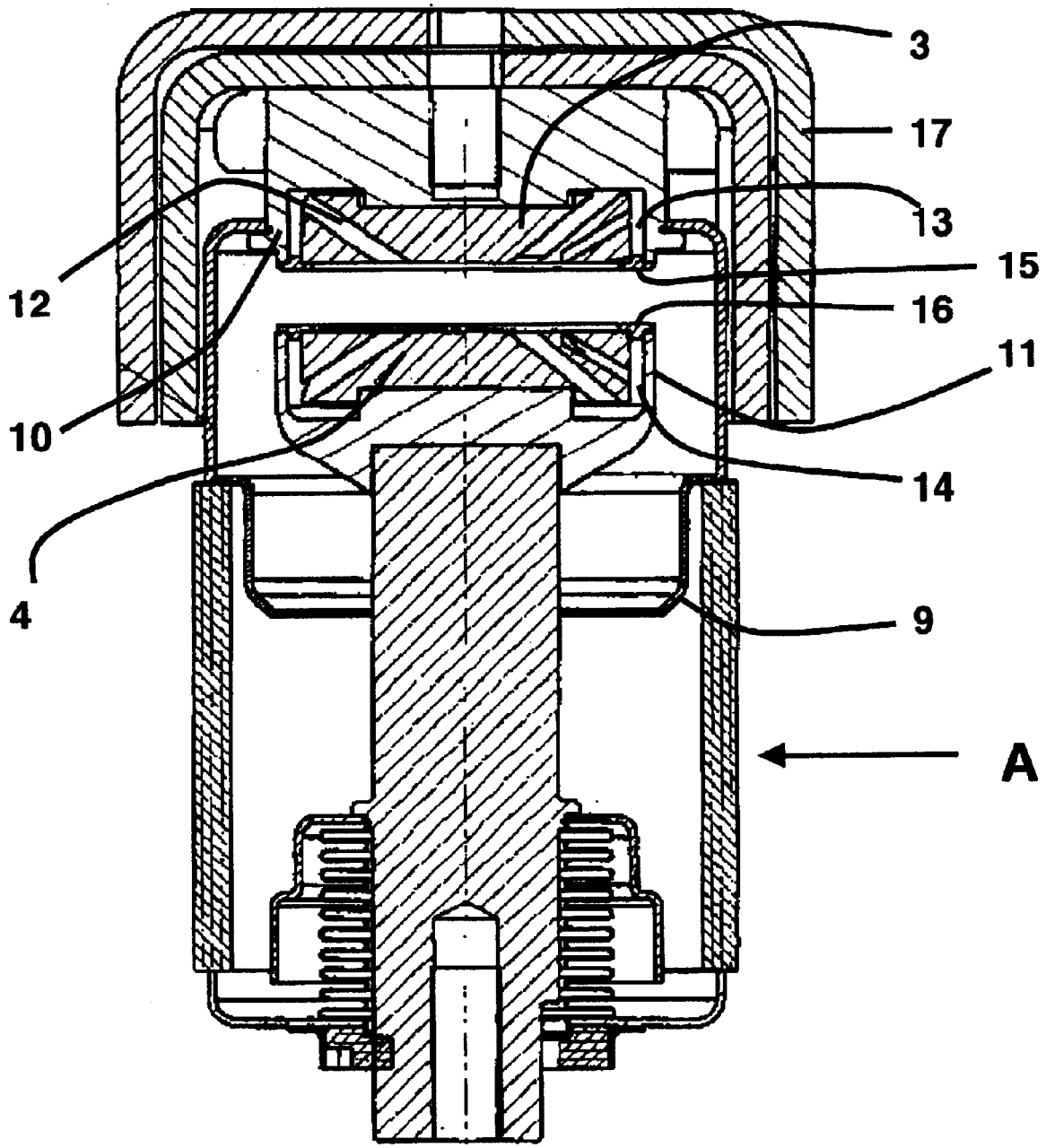
FIG. 6 is an axial sectional view of a cartridge according to the invention, with slits and rings.

In FIG. 6, a cartridge A can be seen comprising an external winding 17 and comprising in addition two rings 15,16 enabling the physical continuity between the two contacts 3,4 to be achieved in the closed position.

The contacts 3,4 of the cartridge A of the previous figure present greater wear than standard cartridges for the following reasons—the liquid created when breaking takes place doesn't stagnate at the surface, and the increase in breaking capacity makes this erosion increase even more. It is then advantageous to separate the place where physical continuity in the closed position of the contacts 3,4 enabling current conduction is achieved from the location on the contacts presenting maximum wear. It is however known that the axial magnetic field created by the external and internal windings stabilizes the arc well and rather tends to displace it to where it is strongest, at least for strong currents. It is at these places that the erosion will be the greatest. It is then advantageous to achieve the physical continuity elsewhere. This physical continuity can be achieved by means of several parts able to take the form of a ring 15,16. For this purpose, the cartridge described in this figure comprises, at the level of each of the contacts 3,4, a ring 15,16 placed above the trench 13,14 separating the shield 10,11 and the contact 3,4. Due to this arrangement, the liquid can flow freely through the slits 12. In this embodiment, the breaking capacity is increased, the value of this increase being able to reach 60% of the breaking capacity associated to a cartridge according to FIG. 1.

It should be noted that this physical continuity can also be achieved with rings having a smaller diameter that are no longer in contact with the shield. This physical continuity can also be achieved by means of studs or sectors of rings.

It should also be noted that the shield could be of another shape than semi-annular, for example rectangular etc. . . .

Figure 9:
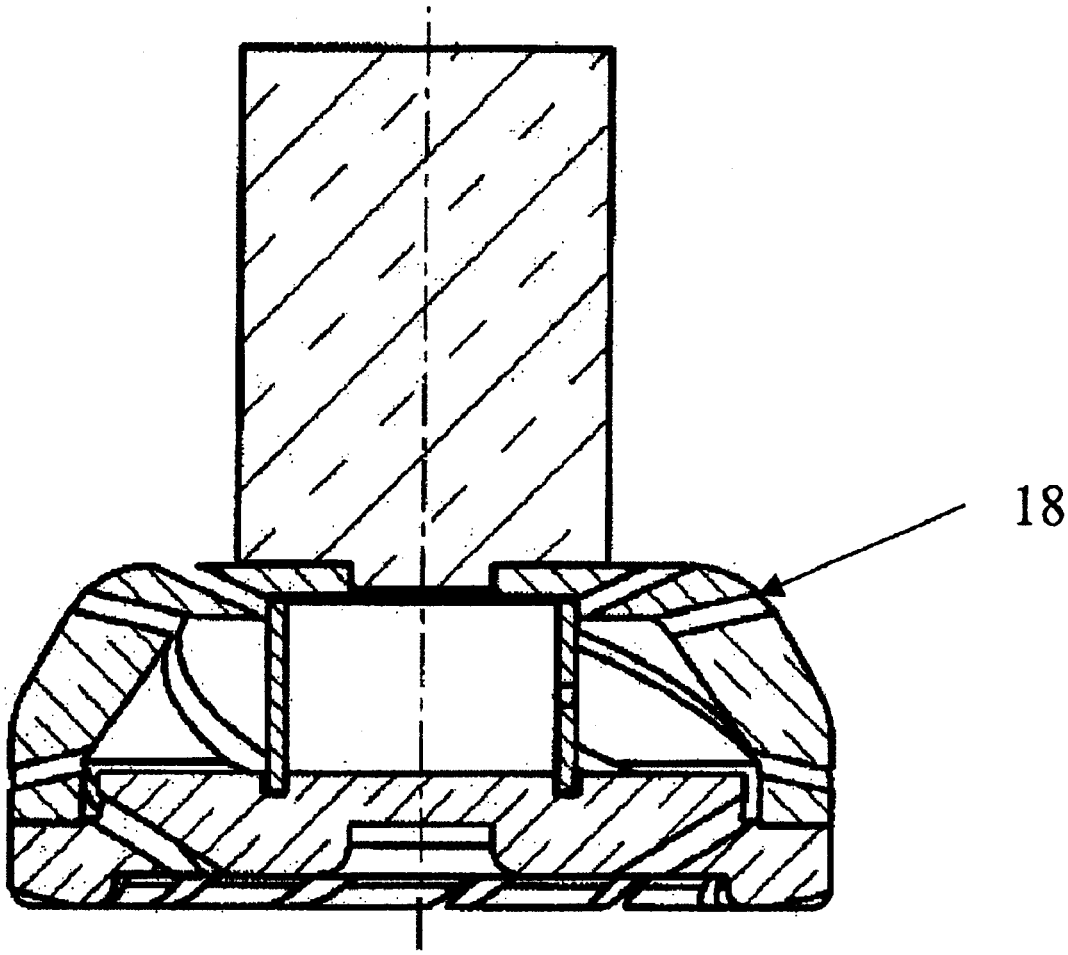
FIG. 9 is an axial sectional view of another embodiment of a vacuum cartridge according to the invention.

In FIG. 9, the shield is also used for conducting a part of the current. When a part of the current passes through the shield, the current can be given a direction of rotation in order that the axial field be increased. This rotation of the current can be obtained by means of inclined slits provided in the shield.

In this figure, it can be seen that the inclination of the slits in the coil constituted by the shield is opposed to the inclination of the slits in the contact. The first ones act to produce the axial magnetic field whereas the second ones act to allow the liquid (melted metal) to flow. Then, due to these different inclinations, the liquid flowing on the contact is thrown against the massive part of the shield; then, the slits in the shield do not allow the passage of the liquid. The shield with the slits fulfils three functions which are respectively, to avoid the throwing of liquid metal, to mechanically support the contact ring and the current conductor, and to increase or create the axial magnetic field between the contacts.

The invention could also advantageously be put into application in a cartridge as described in the Patent FR 2,745,118. In this embodiment of the cartridge not illustrated in the drawings, said cartridge in addition comprises another shield made of conducting material and electrically connected to one of the contacts, said shield being situated inside the enclosure facing the gap separating the contacts and located around the contacts at a preset position according to the position of the current inputs so that when the arc tends to deviate from the above-mentioned gap, this arc places itself between the contacts and the shield.

The switch of this embodiment presents an improved breaking capacity, this breaking capacity being able to be obtained by producing a smaller magnetic field the continuous current-carrying capacity whereof is increased.

Using a shield according to the invention in such a switch enables the breaking capacity to be further increased.

Figure 8:
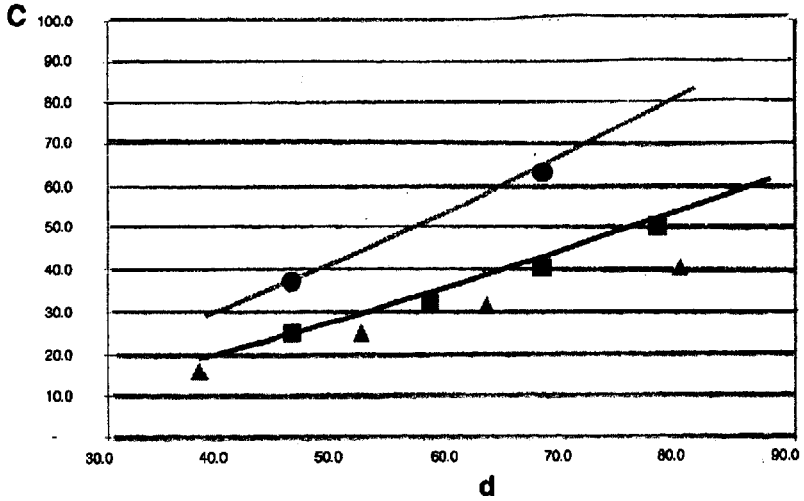
FIG. 8 is a graphic representation illustrating the relation between the breaking capacity and the diameter of the contacts for a cartridge according to the prior art and a cartridge according to the invention.

FIG. 8 illustrates the relation between the breaking capacity c and the diameter of the contacts d for a cartridge according to the invention and for a cartridge according to the prior art. The current c in kA rms is represented on the y-axis, whereas the diameter d of the contacts in mm is represented on the x-axis. In this figure, the points represented by squares represent values obtained with a conventional cartridge comprising an external winding (12 kV). The points represented by triangles represent values obtained with a cartridge comprising an internal winding (24 kV). The circles correspond to shown values. The dark line represents the limit for a cartridge of conventional type using an axial field whereas the light line represents the limit for a cartridge according to the invention.

It can thus be seen on this curve that the values of the breaking capacity for the same contact diameter are greater in the case of a cartridge according to the invention than those concerning a cartridge according to the prior art. This results in the same breaking capacity value being able to be obtained with a contact diameter value reduced by one third.

Furthermore, the cartridge according to the invention presents a more symmetric behavior on breaking, in particular when the cartridge is of the type comprising slits. Thus, the dielectric strength after breaking hardly varies at all with the polarity of the recovery voltage.

Naturally, the invention is not limited to the embodiments described and illustrated which have been given for example purposes only.

On the contrary, the invention encompasses all the technical equivalents of the means described and combinations thereof if these are performed according to the spirit thereof.

What is claimed is:

1. A vacuum cartridge for an electrical protection apparatus, said cartridge comprising:

an enclosure of substantially cylindrical shape symmetrical about a lengthwise axis and closed by two end plates;

two contacts each having a contact surface and extending along the lengthwise axis inside the enclosure, wherein at least one of said contacts, called the movable contact, is connected to an operating mechanism and is mounted for sliding between a closed position of the contacts for enabling current to flow, and an open position wherein the contacts are separated for forming an electric arc in an arc formation zone therebetween; and means for producing a magnetic field parallel to the lengthwise axis in the arc formation zone, comprising:

at least one conducting shield fitted around a periphery of at least one of the contacts, said at least one contact having an edge, said shield for withstanding an electric field arising from a recovery voltage imposed by a power system connected to the vacuum cartridge after interruption of power to the vacuum cartridge, thereby considerably reducing an electric field at the edge of said contact;

at least one trench separating each shield from an associated one of said contacts, wherein at least part of a first ring, sectors of a first ring or studs located on a first contact surface of one of the contacts and facing at least part of a second ring, sectors of a second ring or studs located on a second contact surface of another of the contacts, for establishing electrical continuity across the contacts in the closed position, wherein said at least parts of said first and second rings, sectors of said first and second rings, or said first and second studs are located above said at least one trench.

2. The vacuum cartridge according to claim 1, wherein the shield is for conducting at least a part of current flowing in the contacts.

3. The vacuum cartridge according to claim 2, wherein said shield comprises slits arranged so that said shield comprises a coil.

4. The vacuum cartridge according to claim 1, wherein the shield is electrically connected to an associated one of said two contacts and is sufficiently separated from said associated contact to prevent liquid on the contact surface of said associated contact from reaching said shield.

5. The vacuum cartridge according to claim 1, wherein the shield substantially covers one of said two contacts.

6. The vacuum cartridge according to claim 1, wherein said at least one trench has a width between 0.5 mm and 4 mm.

7. The vacuum cartridge according to claim 6, wherein the trench has a depth of about 5 mm.

8. The vacuum cartridge according to claim 1, wherein the edge is located substantially at a same level as said contact surface, or is in relief relative to the contact surface.

9. The vacuum cartridge according to claim 1, wherein the movable contact comprises a bottom part and the shield comprises a semi-annular shape and is fixed onto the bottom part.

10. The vacuum cartridge according to claim 1, wherein the shield comprises the same material as an associated one of said two contacts.

11. The vacuum cartridge according to claim 1, wherein the shield comprises of a refractory material.

12. The vacuum cartridge according to claim 1, wherein the shield covers the movable contact.

13. The vacuum cartridge according to claim 1, further comprising a second shield fitted around a periphery of a second of said contacts, said second shield for protecting the enclosure from metallization by arc vapor and for increasing a value of the electric field on said second contact.

14. The vacuum cartridge according to claim 13, wherein said second shield is located between said first shield and the enclosure of the cartridge.

15. The vacuum cartridge according to claim 1, wherein the each of said two contacts comprises at least one slit passing therethrough, said at least one slit for receiving liquid and for facilitating liquid flow.

16. The vacuum cartridge according to claim 1, wherein said at least one conducting shield comprises a third shield made of conducting material, said third shield located inside the enclosure and facing a gap separating said two contacts and electrically connected to one of the two contacts, said third shield being located around the two contacts in a preset position according to a position of current inputs so that when an arc between the two contacts tends to deviate from said gap, such arc locates itself between the two contacts and the third shield.

17. The vacuum cartridge according to claim 13, wherein said two contacts each comprise contact slits, and said first and second shields each comprise shield slits, wherein inclination of the contact slits relative to the longitudinal axis is oriented opposite to an inclination of the shield slits relative to the longitudinal axis so that liquid flowing through the contact slits cannot flow through the shield slits.

* * * * *